US006226922B1

(12) United States Patent
Swapp

(10) Patent No.: US 6,226,922 B1
(45) Date of Patent: May 8, 2001

(54) WINDOW SHUTTER

(76) Inventor: Ronald L. Swapp, 1320 W. Elliot #103-511, Tempe, AZ (US) 85284

( * ) Notice: Subject to any disclaimer, the term of this patent is extended or adjusted under 35 U.S.C. 154(b) by 0 days.

(21) Appl. No.: 09/302,045

(22) Filed: Apr. 29, 1999

Related U.S. Application Data

(60) Provisional application No. 60/083,655, filed on Apr. 30, 1998.

(51) Int. Cl.[7] ..... E04B 7/04

(52) U.S. Cl. ..... 49/92.1; 49/74.1; 49/403; 49/91.1; 454/221; 454/224

(58) Field of Search ..... 49/74.1, 92.1, 49/403, 91.1; 454/221, 224

(56) References Cited

U.S. PATENT DOCUMENTS 3,374,576 * 3/1968 Duclon et al. ..... 49/81
3,981,355 * 9/1976 Piercey ..... 49/74
4,027,430 * 6/1977 Sakamoto ..... 49/403
5,921,028 * 7/1999 Marocco ..... 49/403

* cited by examiner

*Primary Examiner*—Carl D. Friedman
*Assistant Examiner*—Patrick J. Chavez
(74) *Attorney, Agent, or Firm*—Gregory J. Nelson

(57) ABSTRACT

A window shutter having a blade assembly which has a non-metallic blade section and an extruded metal mounting section. The metal mounting section is pivotally mounted to the frame and is preferably aluminum or other light materials. In a preferred embodiment, the relative position of the blades to each other and the frame so zero clearance is achieved and in a closed position the blade assemblies overlap to block light. The blade assemblies may be incorporated into a rectangular frame or other style such as a sunburst configuration.

14 Claims, 3 Drawing Sheets

WINDOW SHUTTER

CROSS REFERENCE TO RELATED APPLICATION

The present application is based on Provisional Patent Application Ser. No. 60/083,655, filed Apr. 30, 1998, entitled "Window Shutter".

FIELD OF THE INVENTION

The present invention relates to window shutters and more particularly relates to light blocking window shutters having louvers with blades fabricated from either wood or synthetic material which incorporate an extruded metal reinforcing member to which the blade is attached and on which the louvers pivot with respect to a mounting frame.

BACKGROUND OF THE INVENTION

Various interior window treatments are utilized both in residential and commercial business applications. One widely accepted window treatment is the shutter. The shutter is popular because of its pleasing aesthetic appearance, versatility, adjustability, functionality and environmental control. Shutters can be manufactured to accommodate window openings in various sizes and shapes. Shutters are conventionally made of wood and are fabricated and assembled in a highly labor intensive operation. After fabrication, most shutters are stained or painted. A functional advantage of shutters is that shutters can be adjusted to regulate the desired light level and also serves to deflect sunlight and reduce glare. Shutters are also environmentally beneficial in that they can reduce the heat load transferred to an interior space through a window opening.

Conventional shutters, while widely accepted, are generally expensive to manufacture due to the number of labor operations which must be performed in the fabrication operation. Most of these operations are manual or, at most, semi-automatic. For example, rails forming the shutter frame must be planed, shaped, drilled and routed in the assembly process. Louvers are similarly formed and assembled as part of the structure. If the louvers are of the adjustable type, the louvers are mounted on dowels which are inserted in cooperating bores spaced along the edges of the stiles. Over a period of time, repeated adjustment of the angular position of the louvers on the dowels can cause the bores in the edges of the louvers or in the stiles to wear creating a condition in which the louvers loosen and will not maintain an adjusted position. Further, conventional wooden louvers constructed in this manner are subject to warpage as a result of use and as a result of heat transferred through the window opening and also due to ambient environmental conditions such as moisture.

While, as indicated above, shutters are widely accepted, there nevertheless exist a need for a shutter of an improved construction which provides improved operational capabilities and also better resistance to warpage as a result of heat and environmental exposure. Another desirable feature in window shutters is the ability to completely block out light when the shutters are in a closed position. In addition, it is highly desirable that shutters be made which provide zero clearance at one surface so that when the shutter blade is open, the blade does not interfere or strike adjacent objects such as window frame, door handle or the like.

Various patents relating to shutters of the general type can be found in the prior art including the following:

U.S. Pat. No. 5,001,864 shows a shutter construction having louvers which may be formed of various materials such as plastic, wood or wood materials.

The early patent, U.S. Pat. No. 126,713, to Kelly shows a window blind construction having slats of wood or metal which, when closed, overlap so as to block out light, rain and dust.

U.S. Pat. No. 3,075,257 shows a canopy having tiltable slats which can be closed in an overlapping position to prevent seepage of rain.

Other patents relating to zero clearance feature in shutter construction include the following:

| No. | Title | Patented |
|---|---|---|
| 1,189,572 | Shutter Mechanism, Ilg | |
| 1,817,836 | Register, Petrelli | |
| 2,955,815 | Louvered Wall, Muhr | |
| 2,962,956 | Ventilating Louver Assembly, Magyar | |
| 3,046,619 | Shutter, Shustrom | |
| 4,505,070 | Window Blind, Clipp et al | |
| 4,887,391 | Window Shutter Assembly, Briggs | |
| 4,974,362 | Decorative Shutter, Briggs | |

BRIEF SUMMARY OF THE INVENTION

Briefly, the present invention relates to a zero clearance shutter which has louvers with blades which may be fabricated of wood or synthetic materials and which blades are secured to an extruded mounting section preferably of aluminum or other light weight material. The mounting section is environmentally resistive and does not wear or become loosened over prolonged pivoting operation. Further, the material is resistant to warping which can occur with conventional wooden blades and even some synthetic blades. In the preferred embodiment, the pivot point for adjustability is located on the metal portion of the shutter for better control. The pivot point is also located close to one edge of the louver so that when the louver is open, the tip of the metal portion does not extend substantially beyond the planar surface defined by one surface of the frame. Thus, the design provides zero clearance so that when the shutter blade is open, it does not interfere or strike adjacent objects such as a window frame, door handle or the like. Further, the louver blades are preferably formed having edges formed to cooperatively engage or abut the edges of adjacent louvers to substantially block out light.

BRIEF DESCRIPTION OF THE DRAWINGS

The above and other objects and advantages of the present invention will be more fully understood from the following description, claims and drawings in which:

DETAILED DESCRIPTION OF THE DRAWINGS

Figure 1:
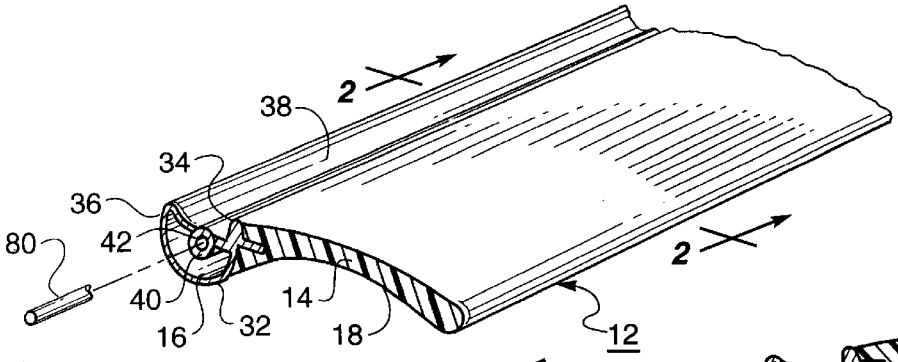
FIG. 1 is a perspective view of a louver for a shutter constructed in accordance with a preferred embodiment of the present invention.
Figure 2:
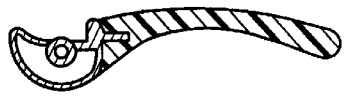
FIG. 2 is a cross-sectional view of the blade according to the present invention taken along line 2—2 of FIG. 1.

Turning now to the drawings, particularly FIGS. 1 to 4, a preferred embodiment of a shutter assembly according to the present invention is shown and is generally designated by the numeral 10. The shutter assembly includes a plurality of louvers 12. Each louver 12 consists of a blade 14 and a support 16. As seen in FIGS. 1 and 2, the blade 14 of the louver has an upper surface 15 which is shown as being slightly convex and an opposed lower surface 18 which is slightly concave. The outer edge of the blade 14 extends arcuately at 20 between the upper and lower surfaces. The inner edge of the blade is a planar or slightly curved surface 22 which is intercepted by a groove 24. Groove 24 20 receives a flange 26 of the support 16.

The blade 14 may be fabricated from any suitable material such as wood but it is preferred the blade is extruded from a suitable synthetic material such as a polymeric material with polyvinyl chloride, polyethylene, polystyrene and polypropylene being representative. Synthetic materials are preferred because of their resistance to warpage and environmental conditions. If the blade is extruded, a suitable coloring agent may be included in the polymeric resin and a desired exterior surface treatment can be applied during the molding process. In the fabrication process, the blades are cut to a suitable length for mounting between oppositely disposed stiles 30 which in conventional shutter installations are the vertical side portions of the shutter frame.

As indicated above, the blades 12 are carried or mounted on a support 16. The support 16 has an arcuate lower edge 32 which extends from edge 34 at a location corresponding to the upper surface 16 of the blade. The lower edge 32 continues to front edge 36 spaced from the vertical surface 22 of the blade. The upper surface of the support curves downwardly and is slightly convex at 38 to a location where it intercepts transversely extending, generally cylindrical pivot support 40. Pivot support 40 defines an aperture or opening 42 for receiving a pin or other member 80 for pivotally mounting the louvers. The louver support is secured to the blade 12 by insertion of the flange 24 of the louver support within the slot 26 formed in the vertical edge of the blade. Further, a suitable adhesive may be applied to secure the louver support to the blade to complete the louver construction.

Preferably the louver support 16 is fabricated as a continuous extruded member from aluminum or other suitable material. The use of a light weight, easily formable metal such as aluminum provides an environmentally resistant, substantially warpage-free support which facilitates and accommodates repeated adjustment of the blade without undue wear of the support surface 42.

Figure 3:
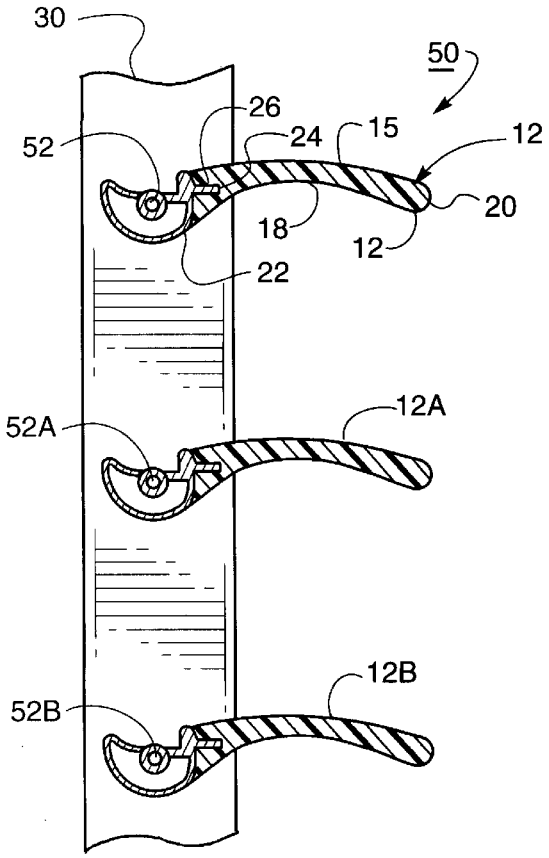
FIG. 3 is a vertical cross-sectional view taken through a shutter assembly showing a plurality of louvers according to the present invention in an open position.

Referring to FIGS. 2 and 3, a portion of a shutter assembly 50 is shown which includes the stile member 30 and a plurality of louvers 12, 12A and 12B. The louvers 12A, 12B are identical or substantially similar to louver 12 described above with the letters "A" and "B" appended for purposes of differentiation. As is conventional, the complete shutter frame assembly 50 would also include a lower horizontal rail and an upper horizontal rail which are not shown as these are conventional and well known to those skilled in the art.

The inner surface of the opposed stiles 30 are provided with aligned bores 52 at spaced-apart locations. The locations are selected so that the end 20 of the next superadjacent louver will engage and overlap a portion 38 of the support when in the closed position as seen in FIG. 3. As will be explained hereafter, this construction provides a light-blocking position.

The louvers are installed by inserting a pivot member 80, preferably a metal pin, in the spaced-apart bores 52, 52A, 52B. The projecting end of the pivot pin is inserted into the associated bore 42 in the louver support 16. Since the louver support and pin are both metal or other durable material, undue wear will not occur over prolonged periods of use during which the shutter blades are pivotally adjusted.

In the open position, the blades 12, 12A and 12B assume a generally parallel, spaced-apart position as shown in FIG. 3. The blade support 16 is also selected so as to have an overall dimension "D" which preferably does not exceed the overall width "W" of the associated stile. The louver blade 12, in the open position, will extend some distance beyond the vertical edge of the stile as shown in FIG. 3. Normally the shutter is installed as shown in FIG. 3 with "F" indicating the front and "R" the rear. The front "F" indicating the surface exposed to the interior of the room when the shutters are used as interior shutters. In this way, the shutters are zero clearance shutters at the interior surface "R" as pivoting the blades from the open position as shown in FIG. 3, to the closed position shown in FIG. 4, will not result in any portion of the louvers extending into the room possibly encountering an obstacle such as an item of furniture or the like.

Figure 4:
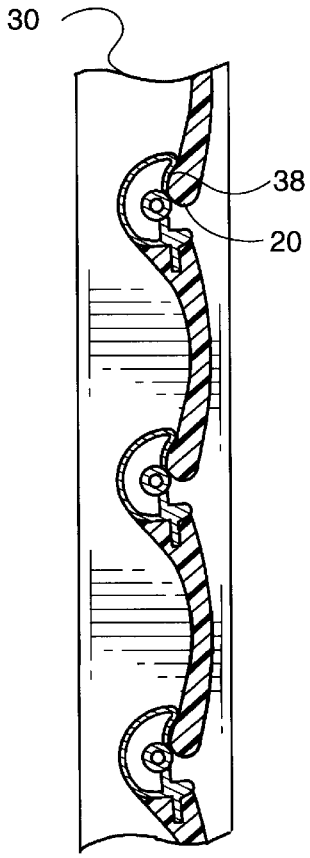
FIG. 4 is a view similar to FIG. 3 showing the louvers in a closed, light-blocking position.

In the closed position shown in FIG. 4, the rear end 20 of the louver will engage the surface 38 of the next lower or subjacent louver support 16. Due to the overlapping engagement in the closed position, complete light blocking occurs so that a room may be fully darkened by closing the shutter louvers. It will be apparent that the shutters may be adjusted to various intermediate positions in accordance with the light conditions desired by the user.

Figure 5:
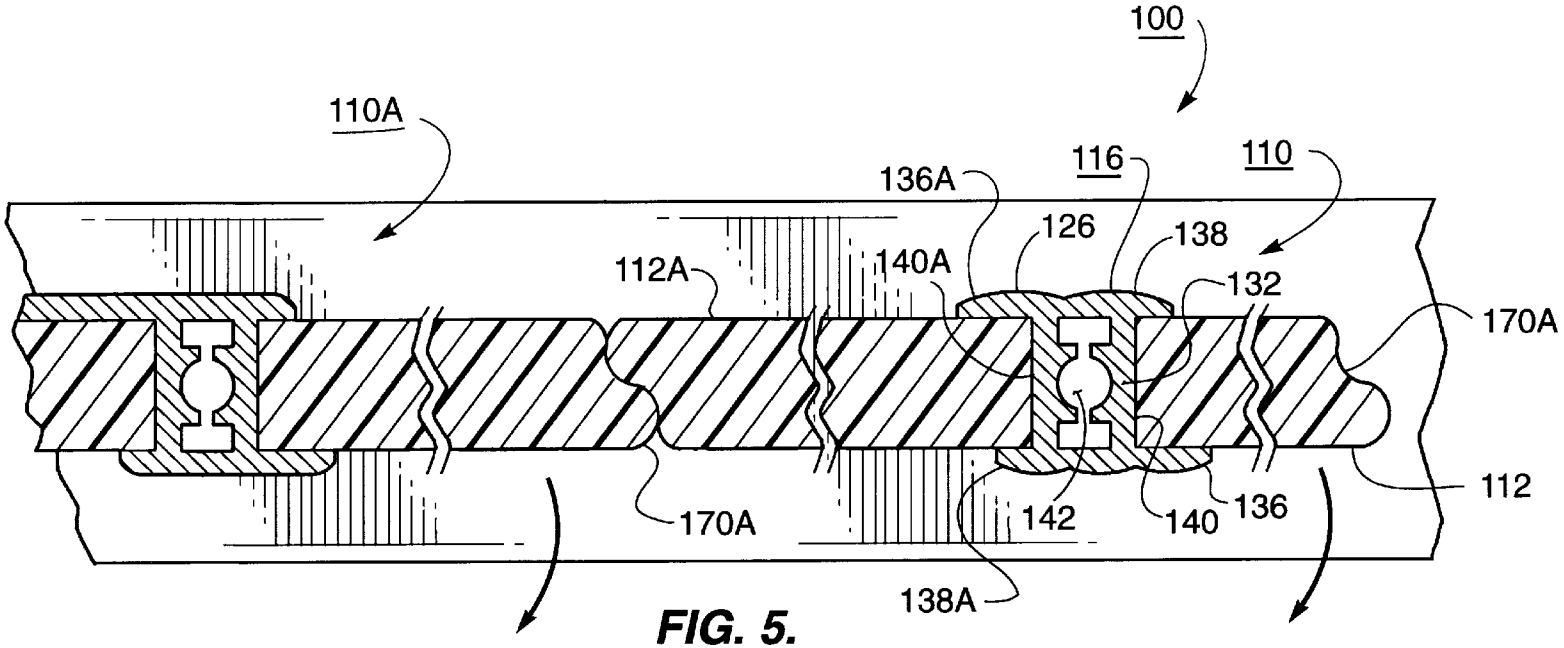
FIG. 5 is a cross-sectional view showing an alternate embodiment of louvers according to the present invention showing the louvers in a closed position.

FIG. 5 shows another embodiment of the present invention generally designated by the numeral 100 and shows a pair of similarly configured louvers 110 and 110A in a closed position. As has been described above, the individual louvers are mounted in stile 130 for rotational adjustment. Each of the louvers 110, 110A include a central louver support 116 which is preferably an extruded member formed of aluminum or other suitable light weight material. The louver support 116 has a body 132 which defines a central transversely extending aperture or opening 142. Aperture 142 is adapted to be positioned on a pivot pin secured in the edge of the stile 130 as described above. The louver support 116 is formed having opposed flanges 136 and 138 which define a seat 140 into which the inner end of the blade 112 is inserted. The blade may be secured by adhesive, heat bonding or other conventional securement techniques. As shown, flange 136 is shown being slightly longer than flange 138 so that it extends a greater distance along the blade 112 to provide support.

Disposed on the opposite side of the louver support 116 are another pair of flanges 136A and 138A which similarly define a seat area 140A for the reception of blade 112A. Blade 112A is secured in conventional fashion to the louver support by adhesives. The blades 112 and 112A may be any suitable length and may be fabricated from any suitable material, natural or synthetic as described above. Preferably, however, to minimize interference with adjacent objects, the overall width of the louver assembly corresponds to approximately the width of the stile so that in the open position the blades do not project substantially beyond either of the faces of the stile 130.

The outer ends of each of the blades 112, 112A each define a recess 170, 170A, respectively, which extend axially along the entire edge of the blade. Recess 170 and 170A are disposed on opposite sides. In this way, as seen in FIG. 5, a portion of the edges of adjacent blades will engage in the closed position to provide substantially full light blocking. The blades may be pivoted in an open position by conventional pivot rod to a full open or intermediate position as desired by the user.

Figure 6:
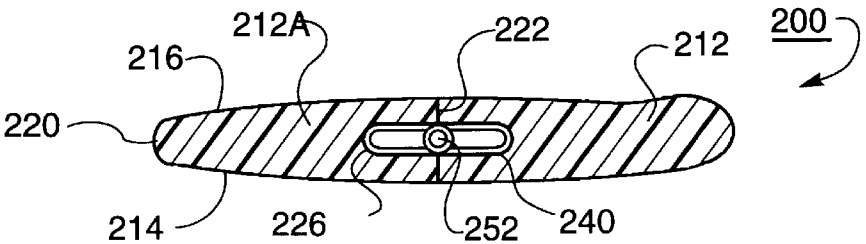
FIG. 6 is a cross-sectional view of yet another embodiment of a louver fabricated in accordance with the present invention.

In FIG. 6, yet another embodiment of a louver according to the present invention is shown generally designated by the numeral 200. The louver consists of opposed blade sections 212, 212A which may be fabricated from any suitable material such as wood or plastic. Each of the blades is shown as having a generally wing-like shape with an upper surface 216 and a lower surface 214 which surfaces are connected at their outer ends at radius 220. Each of the blades 212 has a generally planar inner surface 222 which defines a notch or groove 226 which extends transversely along the blade surface. The groove in each blade receives louver support member 216 which is preferably a member extruded from aluminum or other suitable material. The support 216 has a generally elongated oval-shaped body 240 which defines a cylindrical channel 254 which channel defines a central opening for receipt of a pivot pin. The louver blade 200 can be mounted in conventional fashion within a stile as described above. The support 216 provides stability and reinforces the blades and also provides a wear resistant surface for the pivot pin.

Figure 7:
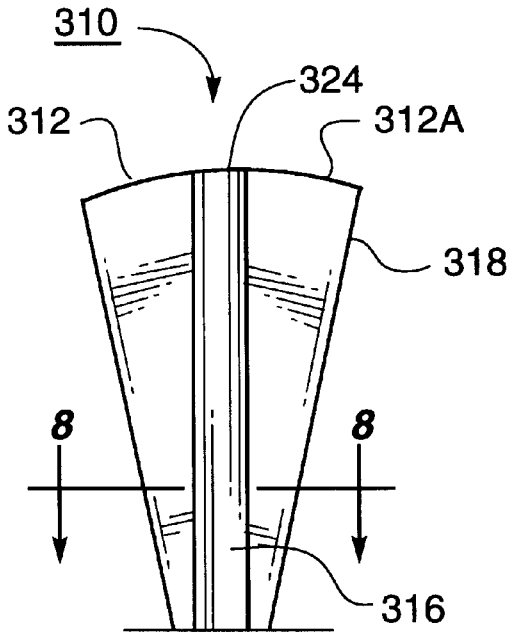
FIG. 7 is a front elevational view of a shutter assembly having radial louvers.
Figure 8:
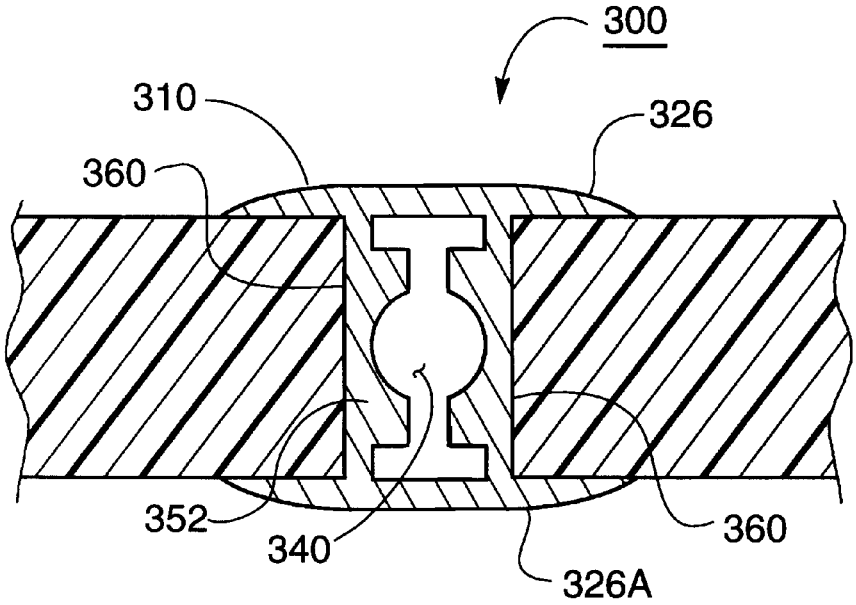
FIG. 8 is a cross-sectional view of a louver taken along line 8—8 of FIG. 7.

The louver assembly of the present invention can also be adapted to be used with other stiles of shutters such as radial or sunburst-type shutter assemblies. FIGS. 7 and 8 show yet another embodiment of the invention designated by the numeral 300. FIG. 7 shows a fan-shaped louver 310 having a pair of opposed blades 312, 312A supported on a centrally extending louver support 316. Again, the blades 312, 312A may be fabricated from any suitable material and are shown having a generally triangular shape with an outer edge 318 and an inner edge 320 which is mounted to the louver support 316.

FIG. 8 is a sectional view taken along line 8—8 of FIG. 7 and more fully shows the louver support 310 which is preferably an extruded member of aluminum or other similar material. The louver support has a body 352 which is shown as being generally rectangular in cross section and which defines radially extending bore 340 which is adapted to receive an operator or control rod, not shown. A flange 326 extends generally perpendicular with respect to the body at one end of the body. A second flange 326A extends perpendicular to the body at the opposite end of the body defining with the body 352 a pair of opposite seat areas 360 and 360A. The seat areas are adapted to mountingly receive the inner edge of the opposed blades 312, 312A. As seen in FIG. 7, the blades 312, 312A are triangular or fan-shaped and when mounted on support 316 form a louver which has an overall fan shape. Louvers of this shape are often used for windows having openings which are semi-circular. The individual shutter blades are arranged in radial fashion having a centrally located operator which will rotate the control rod which is inserted in the radially extending bore 340 in each of the louver assemblies.

From the foregoing, it will be apparent that the present invention provides a unique window shutter assembly and structure. The use of a louver support substantially increases the strength, durability and versatility of the shutters. The blade portion of the various louvers may be wood or may be synthetic materials, also for increased durability. The present invention also lends itself to use with zero clearance shutters and shutters which have complete light blocking capability.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A shutter louver for mounting to a frame comprising:

(a) a blade having opposite ends and having a length extending between the opposite ends, said blade being of a first material;

(b) a support having opposite ends and opposite first and second edges, said support being of a second material less subject to warpage than said first material;

(c) said support being secured to said blade at said first edge to form a louver with said support extending substantially the length of said louver; and (d) a pivotal attachment on at least one end of said support whereof said blade assembly may be pivotally attached to said frame.

2. The shutter blade of claim 1 wherein said blade section is a polymeric material.

3. The shutter blade of claim 1 wherein said metal mounting section is an extruded section.

4. The shutter blade of claim 1 wherein said mounting section has a flange at said inner end and said blade defines a slot at said inner end and said flange is engaged in said slot.

5. The shutter blade of claim 1 wherein said pivotal attachment comprises an aperture to receive a pivot pin.

6. The shutter blade of claim 1 wherein said top surface of said blade is convex and said bottom surface is generally concave.

7. The shutter blade of claim 1 wherein the inner ends of said blade and the second end of said mounting means are in abutting relationship.

8. The shutter blade of claim 1 wherein the first and second ends of the mounting means each define a recess and wherein a blade section is received in each recess.

9. The shutter of claim 6 wherein said outer end of said blade and said mounting means have surfaces which are overlappingly engageable in a predetermined position to block light.

10. A shutter assembly comprising:

(a) a generally rectangular frame having opposite stiles and opposite top and bottom rails, said frame having opposite front and rear surfaces;

(b) a plurality of shutter louvers each louver comprising:

(i) a non-metal blade section having opposite front and rear edges and opposite ends;

(ii) a metal support having a opposite front and rear edges and opposite ends, said blade and support being secured together at the rear edge of the blade and the front edge of the support to form a louver with the metal support section extending substantially the length of the blade; and (iii) said metal support having pivotal attachment means associated therewith at the ends thereof;

(c) said plurality of louvers being arranged in a generally parallel spaced-apart relationship with said pivotal attachment means in pivotal engagement with at least one of said stiles; and (d) said blades being positioned relative to one another having an open position and a closed position in which overlap overlaps the next adjacent louver to block out light.

11. The shutter assembly of claim 8 wherein said blades are generally triangular shaped.

12. The shutter assembly of claim 10 wherein the said support associated with each louver is dimensioned so the support does not project past the plane defined by the rear surface of the frame when the louvers are in said open position.

13. The shutter louver of claim 1 wherein a blade is secured to said support at both said first and second edges of said support.

14. The shutter of claim 10 wherein the distance from the pivotal attachment to the rear edge of the support is less than the distance from the pivotal attachment to the rear of said frame establishing zero clearance.

* * * * *